US012808119B2

(12) United States Patent
Wennerström

(10) Patent No.: US 12,808,119 B2
(45) Date of Patent: Nov. 24, 2026

(54) METHOD FOR BLEACHING PULP FROM RECYCLED TEXTILE MATERIAL

(71) Applicant: VALMET AB, Sundsvall (SE)

(72) Inventor: Maria Wennerström, Sundsvall (SE)

(73) Assignee: VALMET AB, Sundsvall (SE)

( * ) Notice: Subject to any disclaimer, the term of this patent is extended or adjusted under 35 U.S.C. 154(b) by 805 days.

(21) Appl. No.: 18/249,638

(22) PCT Filed: Nov. 8, 2021

(86) PCT No.: PCT/SE2021/051110

§ 371 (c)(1),
(2) Date: Apr. 19, 2023

(87) PCT Pub. No.: WO2022/139651

PCT Pub. Date: Jun. 30, 2022

(65) Prior Publication Data

US 2023/0392320 A1 Dec. 7, 2023

(30) Foreign Application Priority Data

Dec. 21, 2020 (SE) ..... 2051513-6

(51) Int. Cl.

| | |
|---|---|
| ***D21C 9/153*** | (2006.01) |
| ***D21C 9/10*** | (2006.01) |
| ***D21C 9/16*** | (2006.01) |
| ***D21H 11/14*** | (2006.01) |

(52) U.S. Cl.
CPC ..... *D21C 9/153* (2013.01); *D21C 9/1042* (2013.01); *D21C 9/1057* (2013.01); *D21C 9/163* (2013.01); *D21H 11/14* (2013.01)

(58) Field of Classification Search
CPC ..... C08B 15/04; C08B 16/00; C08H 8/00; C08L 1/04; D01F 13/02; D01F 2/00; D21C 5/02; D21C 9/1036; D21C 9/1042; D21C 9/1057; D21C 9/153; D21C 9/163;
(Continued)

(56) References Cited

U.S. PATENT DOCUMENTS

| | | | |
|---|---|---|---|
| 3,318,657 | A | 5/1967 | Wade |
| 2017/0314197 | A1 | 11/2017 | Bergnor et al. |

FOREIGN PATENT DOCUMENTS

| | | | | |
|---|---|---|---|---|
| GB | 2382592 | A * | 6/2003 | ..... D21C 9/002 |
| WO | WO-2015/077807 | A1 | 6/2015 | |

(Continued)

OTHER PUBLICATIONS

D. Vitasari, "The effect of ozone concentration on the bleached pulp properties", conference proceedings, Seminar Nasional Teknoin 2008, pp. 17-21, URL: https://jurnal.uii.ac.id/Teknoin/article/download/2068/1877.

(Continued)

*Primary Examiner* — Lynda Salvatore
(74) *Attorney, Agent, or Firm* — Foley & Lardner LLP

(57) ABSTRACT

The invention relates to a method for bleaching pulp formed from recycled textile material comprising cellulose, said method comprising ozone bleaching (3; 13*a*, 13*b*) of said pulp by means of adding ozone at a charge of at least 12 kg/odt, wherein said ozone bleaching (13*a*, 13*b*) is performed as two subsequent steps, each comprising adding ozone at a charge such that the overall charge is at least 12 kg/odt.

12 Claims, 2 Drawing Sheets

(58) Field of Classification Search
CPC ..... D21C 5/00; D21C 5/027; D21C 9/1073; D21H 11/14; D21H 11/12; Y02W 30/64
See application file for complete search history.

(56) References Cited

FOREIGN PATENT DOCUMENTS

| | | | |
|---|---|---|---|
| WO | WO-2018073177 | A1 | 4/2018 |
| WO | WO-2018/104330 | A1 | 6/2018 |

OTHER PUBLICATIONS

M. Määttänen, "Colour management in circular economy: decolourization of cotton waste", Research Journal of Textile and Apparel, 2019, vol. 23, No. 2, pp. 134-152, ISSN: 1560-6074, DOI: 10.1108/RJTA-10-2018-0058.
H.S. Maqsood et al., "Ozone treatment of jute fibers", Cellulose, 2017, vol. 24, No. 3, pp. 1543-1553, ISSN 0969-0239, DOI: 10.1007/s10570-016-1164-y.
Extended European Search Report issued in connection with EP App. No. 21911669.6 dated Feb. 13, 2024.

* cited by examiner

METHOD FOR BLEACHING PULP FROM RECYCLED TEXTILE MATERIAL

TECHNICAL FIELD

The invention relates to a method for bleaching pulp formed from recycled textile material comprising cellulose, which method comprises ozone bleaching. The invention also relates to a corresponding system.

BACKGROUND

Over the recent years, recycling of textile material has gained interest. The company Renewcell has developed a process for recycling cellulose from textile material comprising cellulose, see for instance WO2018/073177A1. Recycled cellulose can be used for different purposes, for example for producing viscose. In the above-mentioned publication, the need for de-colorization/bleaching of the recycled textile material is identified, and it is suggested to use a combination of oxygen and ozone bleaching.

Ozone bleaching of cellulose pulp from wood material is well known in the art, where ozone reacts with and decomposes lignin originating from the wood material. When it comes to bleaching of pulp from textile material, the purpose of the ozone bleaching is somewhat different—mainly to bleach or decompose color pigments contained in the pulp, which pulp mainly consists of cellulose and liquid (water). Despite the use of ozone, it has, however, proven challenging to achieve sufficient brightness of the resulting pulp. Further, the oxidative properties of ozone will also attack the cellulose fibers and may reduce the viscosity of the resulting pulp to an unsatisfactorily low level. Thus, there is a need for an improved method for bleaching/decolorizing pulp from recycled textile material.

SUMMARY

An object of the invention is to solve or improve on at least some of the problems mentioned above in the background section.

These and other objects are achieved by the present invention by means of a method according to the independent claim.

According the invention, a method for bleaching pulp formed from recycled textile material comprising cellulose is provided. The method comprises ozone bleaching of said pulp by means of adding ozone in two subsequent steps at an overall charge of at least 12 kg/odt, or even more advantageously at a charge of at least 15 kg/odt, where the unit "odt" stands for oven dried ton, where 1 ton is 1000 kg.

When bleaching/delignifiying cellulose pulp from wood material, ozone charges of 8 kg/odt or less are normally used, based on the knowledge that higher charges do not improve the brightness of the resulting pulp. Contrary to this conventional practice within the field of ozone bleaching, the present invention is based on the insight that significantly higher charges, such as 12 kg/odt or even 15 kg/odt, further improve the brightness of the resulting pulp to a surprising extent when the cellulose pulp being bleached is formed from recycled textile material. Experimental data have shown that unbleached pulp having an ISO brightness of about 65% can bleached to a brightness of about 80% solely using two ozone bleaching steps as defined by the inventive method. By supplementing the ozone bleaching with further bleaching steps such as a peroxide bleaching step and/or a chlorine dioxide bleaching step, a satisfactory final brightness of about 90% is obtainable or even higher.

In embodiments, the method comprises pretreating the pulp prior to said ozone bleaching, wherein the pretreating comprises adding at least one acid to reduce the pH of the pulp, and adding one or more additives. The one or more additives may be added together with, or simultaneously with the at least one acid. Alternatively, the one or more additives may be added prior to, or after the at least one acid. The at least one acid may comprise sulphuric acid. The at least one acid may be added at a charge such that the pH is reduced to within a range from 2 to 3, preferably from 2 to 2.5 or from 2.5 to 3. The one or more additives may comprise one or more chelating agents and/or radical scavengers. Chelating agents provide the effect that selectivity in the ozone bleaching step is improved by reducing the content of metal ions in the pulp, which metal ions catalyze the degradation of ozone to free radicals, which in turn cause cellulose degradation. Radical scavengers have a similar effect by scavenging the metal ions. The use of chelating agents and radical scavengers has proven particularly advantageous together with the unusually high ozone charges used in the present invention, which otherwise may cause excessive cellulose degradation and consequently too low viscosity of the resulting pulp. The one or more additives may be chosen from a group comprising oxalic acid, acetic acid, ethylenediaminetetraacetic acid, EDTA, diethylenetriaminepentaacetic acid, DTPA, magnesium sulfate or calcium chloride.

In embodiments, the additives may be added at charge of 1-2 kg/odt. Ozone may be added as a gas mixture, for example with 8-14% ozone by weight in an ozone-air mixture. The ozone bleaching steps may be performed for a duration of 1-10 minutes, for example at a temperature of 40-70° C., for example at a pulp consistency of 30-42%, preferably 34-40%.

In embodiments, the method comprises one or more further bleaching steps after the ozone bleaching. For example, the method may comprise a hydrogen peroxide bleaching step after the ozone of the pulp. The method may further comprise, after the peroxide bleaching, a chlorine dioxide bleaching step. In other embodiments, the chlorine dioxide bleaching step is performed prior to the peroxide bleaching step. In yet other embodiments, a chlorine dioxide bleaching step is performed after the ozone bleaching without a preceding or following peroxide bleaching step.

In embodiments comprising a peroxide bleaching step and a subsequent chlorine dioxide bleaching step, the method preferably comprises, prior to or during the peroxide bleaching, adding a radical scavenger such as magnesium sulfate. Addition of a radical scavenger in this manner has surprisingly proven to have a positive effect on the viscosity after the chlorine dioxide bleaching step. More specifically, the radical scavenger has not proven to have any significant effect on the (loss of) viscosity over the peroxide step, but has an effect on the chlorine dioxide bleaching step in the sense that the viscosity loss is substantially reduced or even prevented.

In embodiments, the pulp has a consistency of at least 30%, preferably within a range from 35-42% prior to the ozone bleaching step. Ozone bleaching of this kind of pulp has proven to be difficult to carry out on medium-consistency pulp since the high amount of liquid may in this case prevent the ozone to penetrate into the dry content (cellulose) of the pulp. It is therefore advantageous to provide the pulp at high consistency (at least 30%, preferably 35-42% consistency) to the ozone bleaching steps. In other words, the method comprises providing the pulp at such high consistency, or alternatively providing the pulp at low or medium consistency whereafter the pulp is subjected to a dewatering/thickening step prior to the ozone bleaching steps. Dewatering/thickening of cellulose pulp is well known in the art and will not be described in further detail here.

In embodiments, the method comprises oxygen bleaching of the pulp prior to the ozone bleaching. In embodiments comprising pretreating, the oxygen bleaching step is performed prior to said pretreating step. In other embodiments, the method comprises oxygen bleaching of the pulp after the ozone bleaching. Oxygen bleaching, i.e. bleaching by means of adding oxygen is well known in the art and will not be described in further detail here.

It is understood that the method for bleaching normally comprises one or more washing steps, between the bleaching steps, for instance after the ozone bleaching, i.e. prior to any further bleaching steps.

The features of the embodiments described above are combinable in any practically realizable way to form embodiments having combinations of these features. Further, all features and advantages of embodiments described above with reference to the first aspect of the invention may be applied in corresponding embodiments of the second aspect of the invention.

BRIEF DESCRIPTION OF THE DRAWINGS

Above discussed and other aspects of the present invention will now be described in more detail using the appended drawings, which show presently preferred embodiments of the invention, wherein.

DETAILED DESCRIPTION

Figure 1:
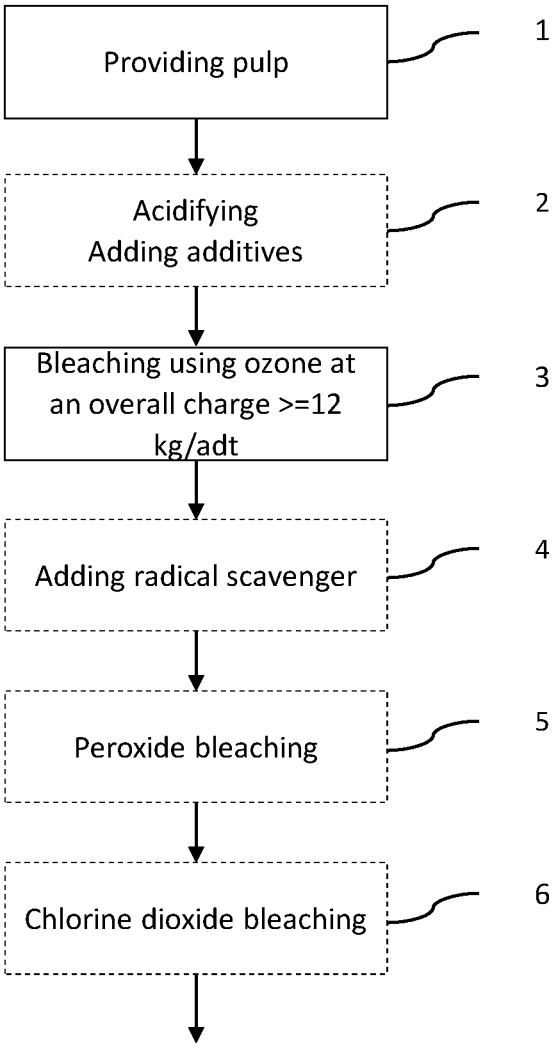
FIG. 1 shows a flowchart illustrating an embodiment of the method according to the invention, and FIG. 2 schematically illustrates another embodiment of a method according to the invention.

FIG. 1 shows a flowchart illustrating an embodiment of the method according to the first aspect of the invention. The method comprises providing 1 pulp at a consistency, which in embodiments of the invention is at least 30%, preferably within a range from 35-42%. Thereafter, the pulp is pretreated 2, which comprises the sub-steps of adding sulphuric acid to reduce the pH of the pulp to within a range from 2 to 3, and adding additives together with, or simultaneously with the sulphuric acid. The additives comprise EDTA. The pretreated pulp is thereafter subjected to ozone bleaching 3 by means of adding ozone in two subsequent steps at an overall charge of at least 12 kg/odt. In an embodiment of the invention, the overall charge is at least 15 kg/odt. The ozone bleached pulp is thereafter subjected to an optional hydrogen peroxide bleaching step 5. Concurrently with, or immediately before the peroxide bleaching step, adding 4 a radical scavenger such as magnesium sulfate. After the peroxide bleaching, the pulp is optionally subjected to chlorine dioxide bleaching 6. Although not shown in the flowchart in FIG. 1, it is understood that the method further comprises at least one washing step; washing steps may be comprised in the providing step 1, between the ozone bleaching 3 and peroxide bleaching 5 and/or between the peroxide bleaching 5 and chlorine dioxide bleaching 6. Suitable devices for carrying out the above-mentioned steps are well known in the art and will not be described herein.

Figure 2:
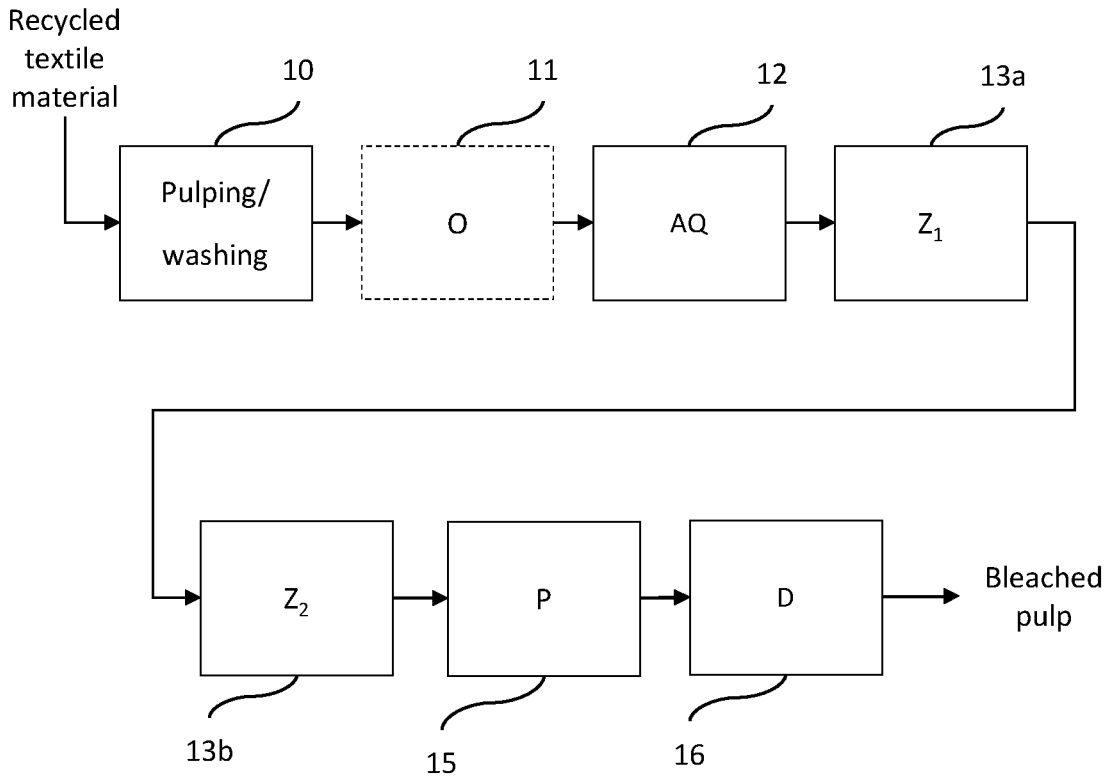

FIG. 2 schematically illustrates another embodiment of a method according to the first aspect of the invention. The method comprises pulping 10 the recycled textile material to form cellulose pulp, for instance by swelling the material under reducing conditions as described in WO2018/073177A1. The pulping 10 may comprise washing the formed pulp prior to an optional oxygen bleaching stage 11 in which gaseous oxygen is introduced into the liquid phase of the (high-consistency) pulp. The oxygen bleaching optionally comprises dewatering the pulp and/or adding an alkaline such that the oxygen bleaching is carried out at alkaline conditions. The oxygen bleaching 11 may comprise washing the formed pulp prior to pretreating 12. The pulp is pretreated 12 by adding sulphuric acid to reduce the pH of the pulp to within a range from 2 to 3, and adding additives together with, or simultaneously with the sulphuric acid. The additives comprise oxalic acid and/or EDTA and/or magnesium sulfate. The pretreatment may comprise diluting the pulp to low consistency prior to adding acid and additives. The additives may be added at charge of 1-2 kg/odt. The pulp is preferably dewatered/thickened prior to the first ozone bleaching 13*a* such that the pulp is provided thereto at a consistency of at least 30%, preferably within a range from 35-42%. After the first ozone bleaching stage, the pulp is subjected to a second ozone bleaching stage 13*b*. Ozone is added as a gas mixture, for example with 8-16% ozone by weight in an ozone-air mixture, preferably 10-12% ozone by weight. The ozone bleaching step may be performed for a duration of 1-10 minutes at a temperature of 40-70° C. The overall ozone charge of the two ozone bleaching stages combined amounts to at least 12 kg/odt, or 15 kg/odt. The ozone bleached pulp is thereafter sent to a hydrogen peroxide bleaching stage 15, optionally via a washing stage. A radical scavenger such as magnesium sulfate is added in the peroxide bleaching stage 15. After the peroxide bleaching, the pulp is subjected to a chlorine dioxide bleaching stage 16. Optionally, the pulp is subjected to a washing stage between the peroxide and chlorine dioxide bleaching stages.

The description above and the appended drawings are to be considered as non-limiting examples of the invention. The person skilled in the art realizes that several changes and modifications may be made within the scope of the invention. For example, depending on the required brightness of the resulting pulp, one or more of the bleaching step(s) prior to or after the ozone bleaching step(s) may be omitted, for example the chlorine dioxide bleaching step (along with the related addition of a radical scavenger step) may be omitted, or the peroxide bleaching step may be omitted. Furthermore, the ozone bleaching may be performed using fewer or further sub steps.

The invention claimed is:

1. A method for bleaching pulp formed from recycled textile material comprising cellulose, said method comprising:

pretreating the pulp, wherein said pretreating comprises:

adding at least one acid to reduce the pH of the pulp, and adding one or more radical scavengers comprising magnesium sulfate; and ozone bleaching said pulp, which comprises two steps of adding ozone, such that a sum of amounts of ozone added in the two steps is at least 12 kg/odt.

2. The method according to claim 1, wherein:

the sum of the amounts of ozone added in the two steps is at least 15 kg/odt.

3. The method according to claim 1, wherein:

pretreating further comprises adding one or more chelating agents.

4. The method according to claim 1, further comprising:

after said ozone bleaching, peroxide bleaching the pulp.

5. The method according to claim 4, further comprising:

after said peroxide bleaching, chlorine dioxide bleaching the pulp.

6. The method according to claim 1, wherein:

prior to the ozone bleaching, the pulp is provided at a consistency of at least 30%.

7. The method according to claim 1, wherein:

prior to the ozone bleaching, the pulp is provided at a consistency within a range from 35-42%.

8. The method according to claim 1, wherein:

the two steps of adding ozone are consecutive.

9. A method for bleaching pulp formed from recycled textile material comprising cellulose, said method comprising:

ozone bleaching said pulp, which comprises two steps of adding ozone, such that a sum of amounts of ozone added in the two steps is at least 12 kg/odt; and after said ozone bleaching, peroxide bleaching the pulp.

10. The method according to claim 9, further comprising:

pretreating the pulp prior to said ozone bleaching, wherein said pretreating comprises:

adding at least one acid to reduce the pH of the pulp, and adding one or more additives.

11. The method according to claim 10, wherein:

said one or more additives comprises at least one of oxalic acid, acetic acid, ethylenediaminetetraacetic acid, EDTA, diethylenetriaminepentaacetic acid, DTPA, magnesium sulfate or calcium chloride.

12. The method according to claim 9, wherein:

prior to or during said peroxide bleaching, adding a radical scavenger.

* * * * *